US008061315B2

(12) United States Patent
Nakamura et al.

(10) Patent No.: US 8,061,315 B2
(45) Date of Patent: Nov. 22, 2011

(54) VARIABLE VALVE ACTUATING APPARATUS FOR INTERNAL COMBUSTION ENGINE AND CONTROL SHAFT FOR VARIABLE VALVE ACTUATING APPARATUS

(75) Inventors: Makoto Nakamura, Isehara (JP); Seinosuke Hara, Atsugi (JP); Seiji Tsuruta, Atsugi (JP); Mikihiro Kajiura, Inagi (JP)

(73) Assignee: Hitachi, Ltd., Tokyo (JP)

( * ) Notice: Subject to any disclaimer, the term of this patent is extended or adjusted under 35 U.S.C. 154(b) by 441 days.

(21) Appl. No.: 12/402,017

(22) Filed: Mar. 11, 2009

(65) Prior Publication Data

US 2009/0235886 A1 Sep. 24, 2009

(30) Foreign Application Priority Data

Mar. 24, 2008 (JP) ..... 2008-074823

(51) Int. Cl.
*F01L 1/34* (2006.01)

(52) U.S. Cl. ..... 123/90.16; 123/90.39; 123/90.44; 74/559; 74/569

(58) Field of Classification Search ..... 123/90.15, 123/90.16, 90.17, 90.18, 90.39, 90.44; 74/559, 74/567, 569
See application file for complete search history.

(56) References Cited

U.S. PATENT DOCUMENTS 5,988,125 A 11/1999 Hara et al.
7,942,123 B2 * 5/2011 Hara et al. ..... 123/90.39

FOREIGN PATENT DOCUMENTS

JP 11-107725 A 4/1999

* cited by examiner

*Primary Examiner* — Ching Chang
(74) *Attorney, Agent, or Firm* — Foley & Lardner LLP

(57) ABSTRACT

A variable valve actuating apparatus for an internal combustion engine includes: a control shaft rotatably supported through a bearing to a body of the engine, and arranged to rotate about a center axis to control an operating state of an engine valve, the control shaft including; a control cam having a center which is off the center axis of the control shaft in a first direction; and a journal portion rotatably supported by the bearing, the journal portion having a center axis which is off the center axis of the control shaft in a second direction different from the first direction of the control cam.

21 Claims, 13 Drawing Sheets

VARIABLE VALVE ACTUATING APPARATUS FOR INTERNAL COMBUSTION ENGINE AND CONTROL SHAFT FOR VARIABLE VALVE ACTUATING APPARATUS

BACKGROUND OF THE INVENTION

This invention relates to a variable valve actuating apparatus for an internal combustion engine that is arranged to control an operating state of an intake valve or an exhaust valve in accordance with an engine operating condition, and a control shaft used for the variable valve actuating apparatus.

U.S. Pat. No. 5,988,125 (corresponding to Japanese Patent Application Publication No. 11-107725) shows a variable valve actuating apparatus including a drive shaft arranged to be rotated by a crank shaft; a drive cam integrally provided on an outer circumference of the drive shaft, a transmitting mechanism which is a multiple joint link, and which has a link arm, a link rod, and a rocker arm arranged to convert a rotational force of the drive cam to a swing motion; and a swing cam arranged to receive the motion of the drive cam. This swing cam is slid on an upper surface of a valve lifter, and arranged to open and close an intake valve and so on.

This rocker arm includes a first end portion rotatably connected through the link arm to the drive cam, and a second end portion rotatably connected through the link rod to the swing cam. This rocker arm includes a supporting hole formed at a substantially central portion in the longitudinal direction, and provided with an eccentric control cam integrally provided on a control shaft. The rocker arm is arranged to swing about the eccentric cam.

This variable valve actuating apparatus is arranged to control a rotational position of the control cam through the control shaft by an actuator in accordance with an engine operating condition, to vary a fulcrum (pivot point) of the rocker arm, and to vary a valve lift quantity and an operation angle of the intake valve by the swing cam.

SUMMARY OF THE INVENTION

However, in the conventional variable valve actuating apparatus, it is not possible to increase an inside diameter of the supporting hole of the rocker arm for problems of increase of the weight and the size. Accordingly, it is not possible to increase the eccentric quantity of the control cam with respect to the control shaft. Therefore, the variation of the fulcrum (pivot point) of the rocker arm is restricted, and it is difficult to get the performance of the variable valve actuating apparatus, that is, the engine.

It is, therefore, an object of the present invention to provide a variable valve actuating apparatus devised to solve the above mentioned problem, and to increase the eccentric quantity of the control cam.

According to one aspect of the present invention, a variable valve actuating apparatus for an internal combustion engine, the variable valve actuating apparatus comprises: a control shaft rotatably supported through a bearing to a body of the engine, and arranged to rotate about a center axis to control an operating state of an engine valve, the control shaft including; a control cam having a center which is off the center axis of the control shaft in a first direction; and a journal portion rotatably supported by the bearing, the journal portion having a center axis which is off the center axis of the control shaft in a second direction different from the first direction of the control cam.

According to another aspect of the invention, a variable valve actuating apparatus for an internal combustion engine, the variable valve actuating apparatus comprises: a control shaft arranged to rotate about a center axis to control an operating state of an engine valve, the control shaft including; a shaft portion extending in an axial direction, and arranged to rotate about a center axis; a substantially cylindrical control cam provided on the shaft portion, and arranged to rotate about a center; and substantially cylindrical journal portions provided on both sides of the control cam in the axial direction, and rotatably supported by bearings provided to a body of the engine, the journal portions having a center axis which is separated from the center axis of the shaft portion, and which is different from the center of the control cam.

According to still another aspect of the invention, a control shaft for a variable valve actuating apparatus, the control shaft arranged to rotate to control an operating state of an engine valve, the control shaft comprises: a shaft portion; a control cam including an outer circumferential surface which protrudes radially outwards from the shaft portion, whose a protruding quantity varies in accordance with a circumferential direction, and which protrudes in a first direction by a maximum quantity; and a substantially cylindrical journal portion which is supported by a bearing provided to an engine, and which is eccentric in a second direction different from the first direction of the control cam.

DETAILED DESCRIPTION OF THE INVENTION

Hereinafter, variable valve actuating apparatuses according to embodiments of the present invention will be illustrated with reference to the drawings. The variable valve actuating apparatuses according to the embodiments are applied to a multi-cylinder internal combustion engine including a variable valve actuating mechanism having two intake valves provided to each cylinder, and arranged to vary a valve lift quantity in accordance with an engine operating condition.

First Embodiment

Figure 1:
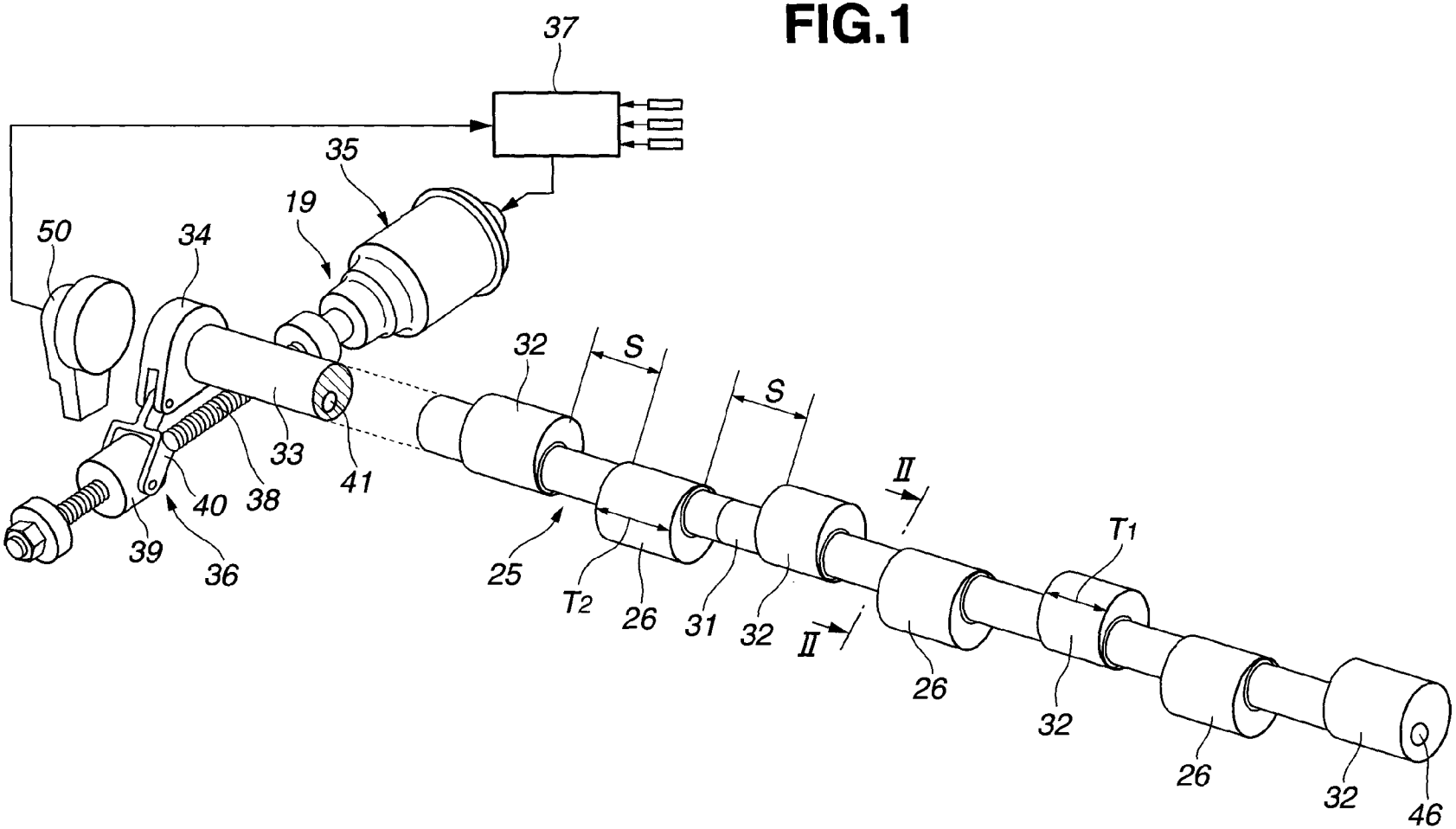
FIG. 1 is a perspective view showing a control shaft, a control cam, and a control mechanism provided to a variable valve actuating apparatus according to a first embodiment of the present invention.
Figure 2:
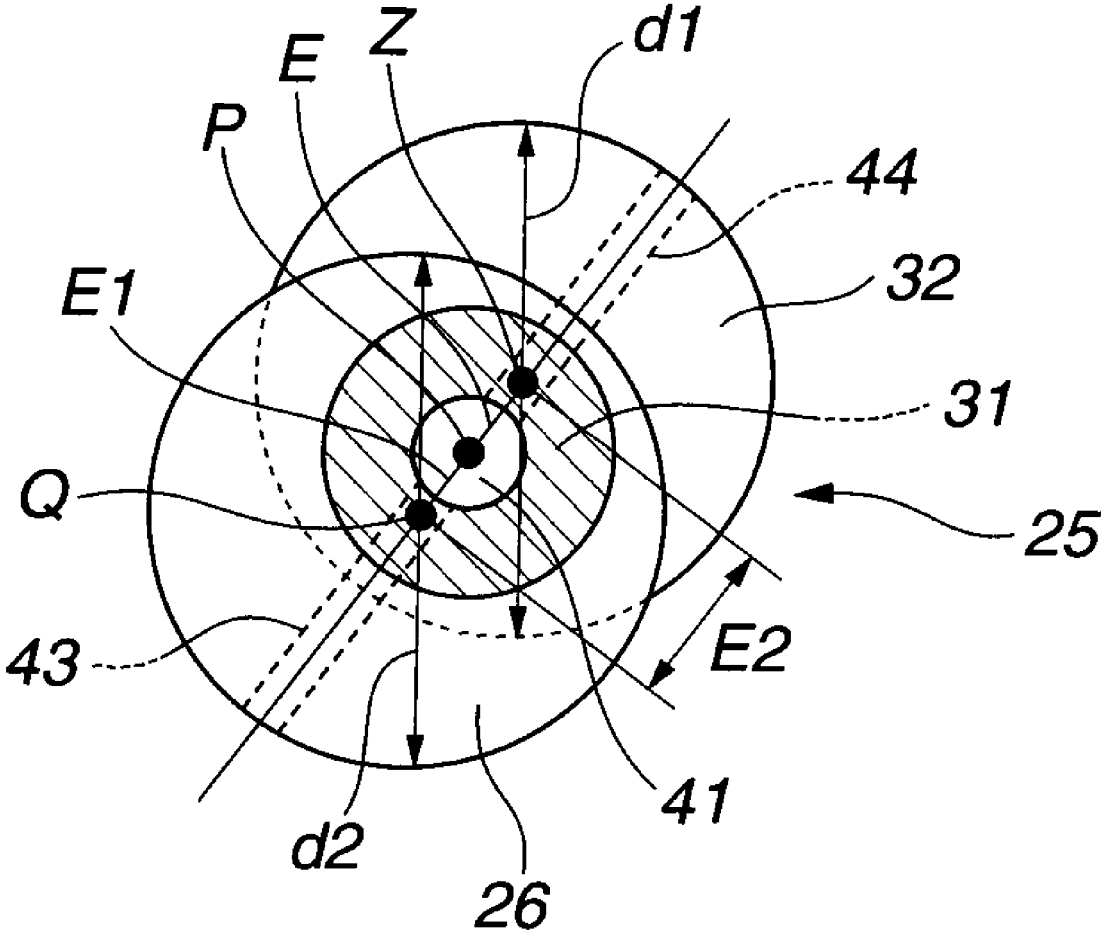
FIG. 2 is a sectional view taken along a section line II-II of FIG. 1.
Figure 3:
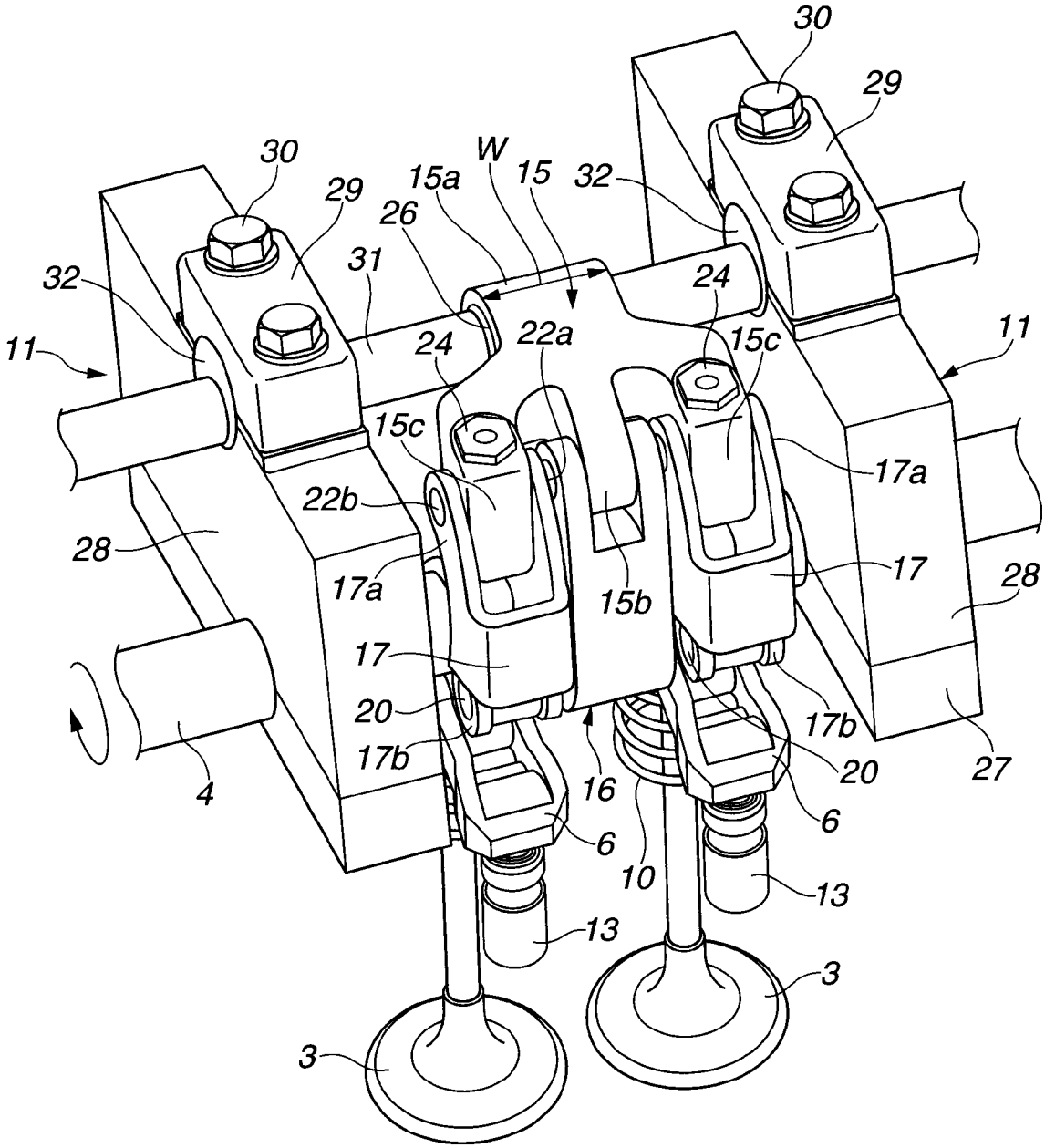
FIG. 3 is a perspective view showing a main part of the variable valve actuating apparatus according to the first embodiment of the present invention.
Figure 4:
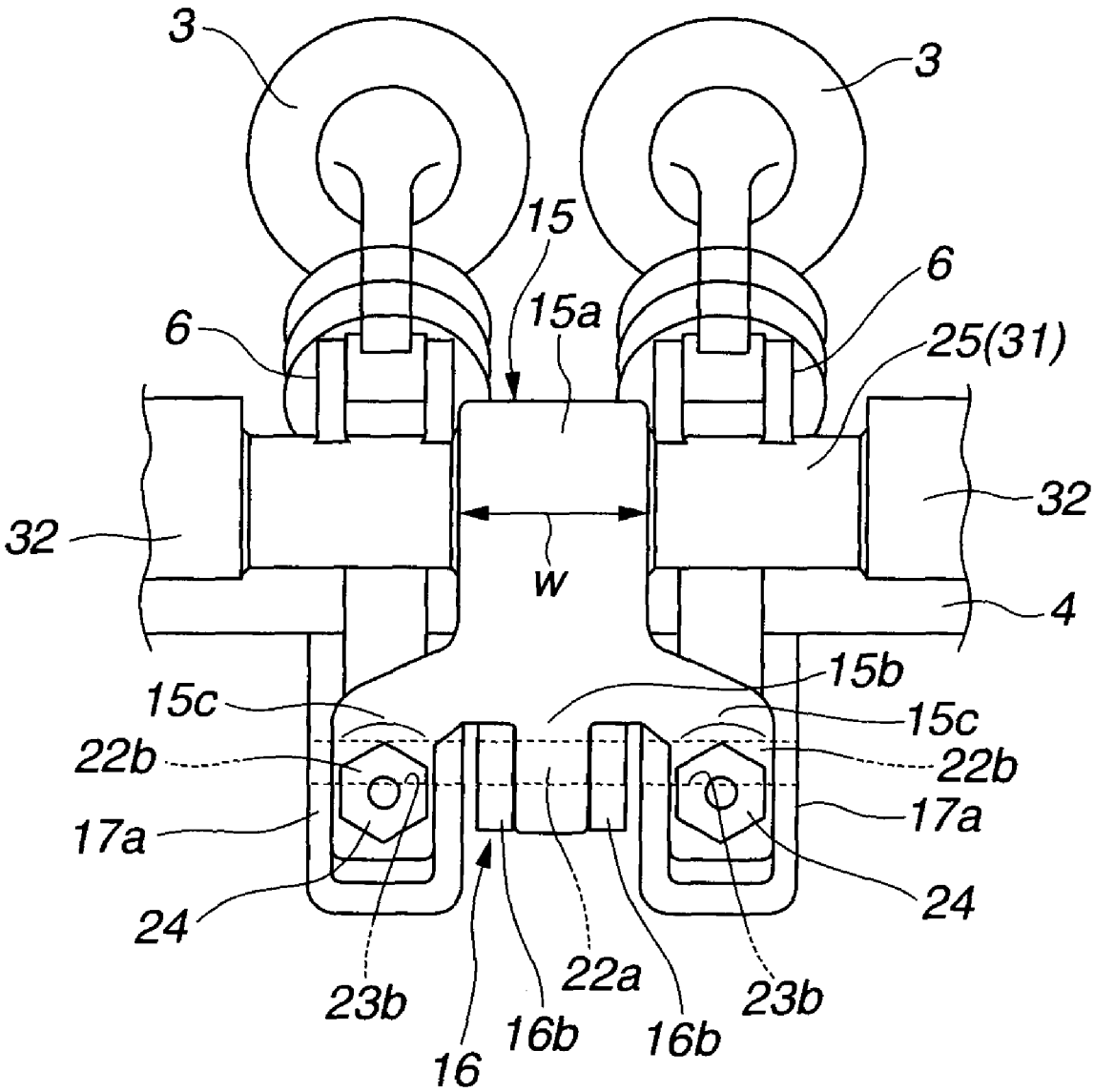
FIG. 4 is a plan view showing the main part of the variable valve actuating apparatus according to the first embodiment of the present invention.
Figure 5:
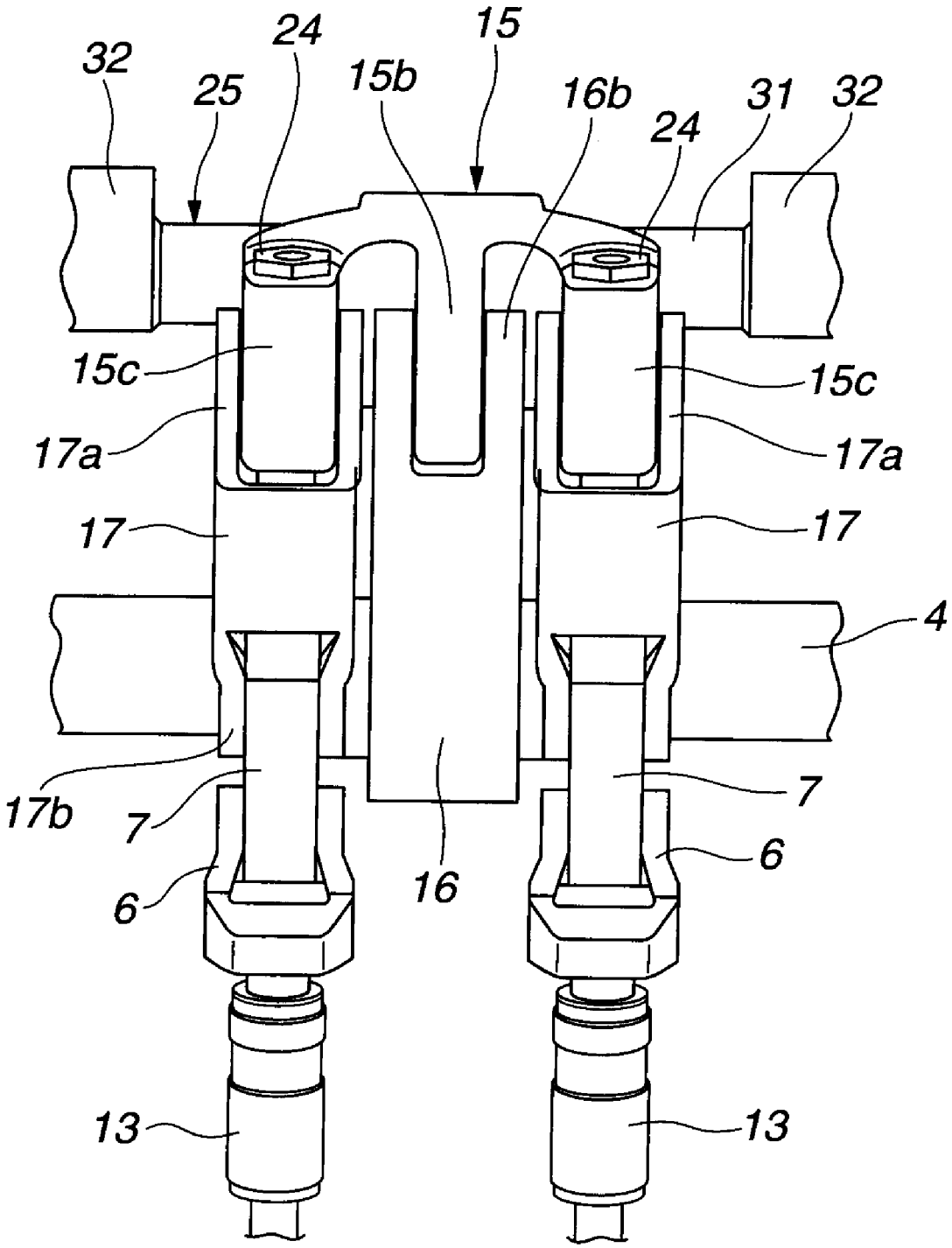
FIG. 5 is a front view showing the main part of the variable valve actuating apparatus according to the first embodiment of the present invention.
Figure 6:
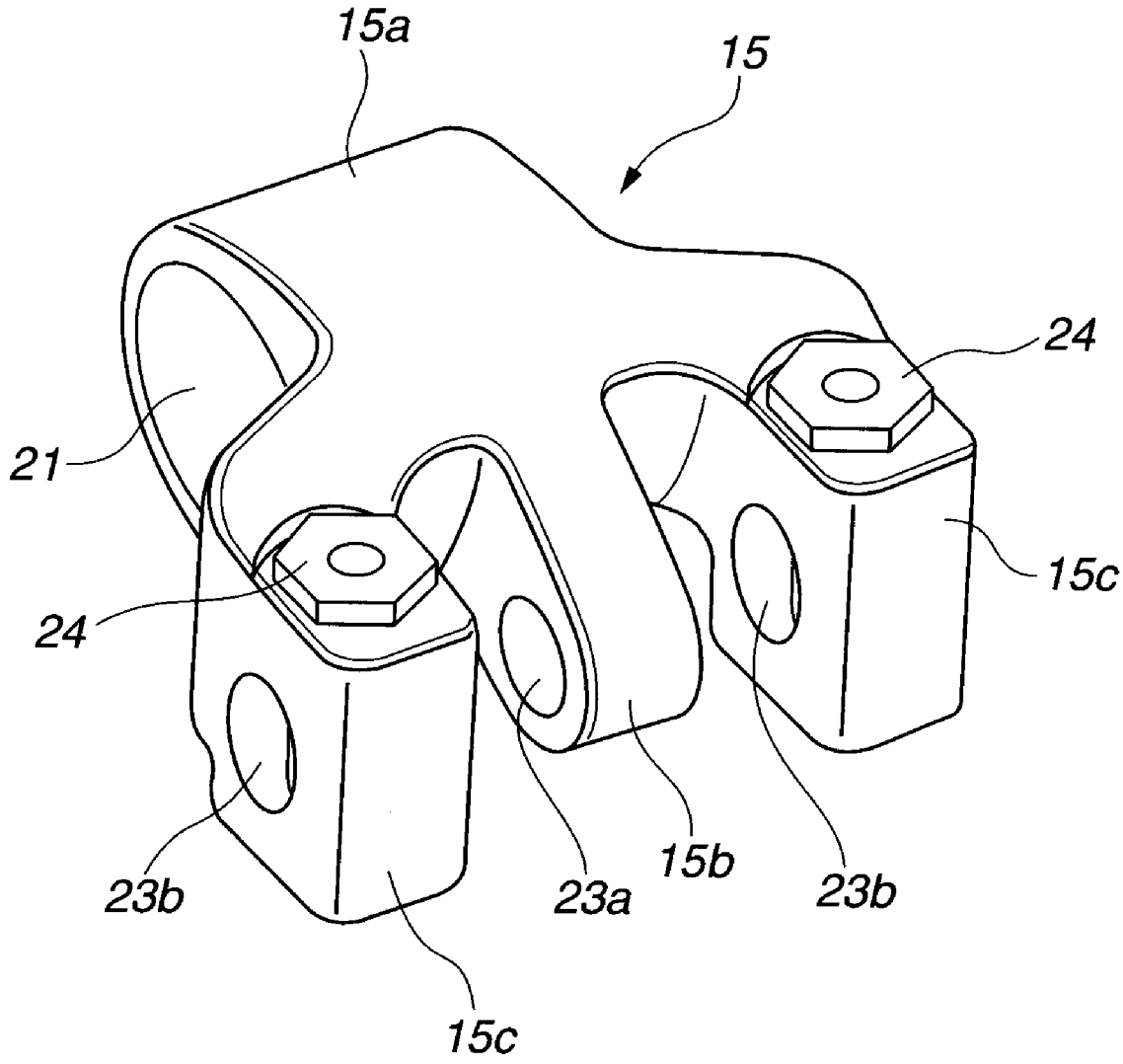
FIG. 6 is a perspective view showing a rocker arm provided to the variable valve actuating apparatus according to the first embodiment of the present invention.
Figure 7:
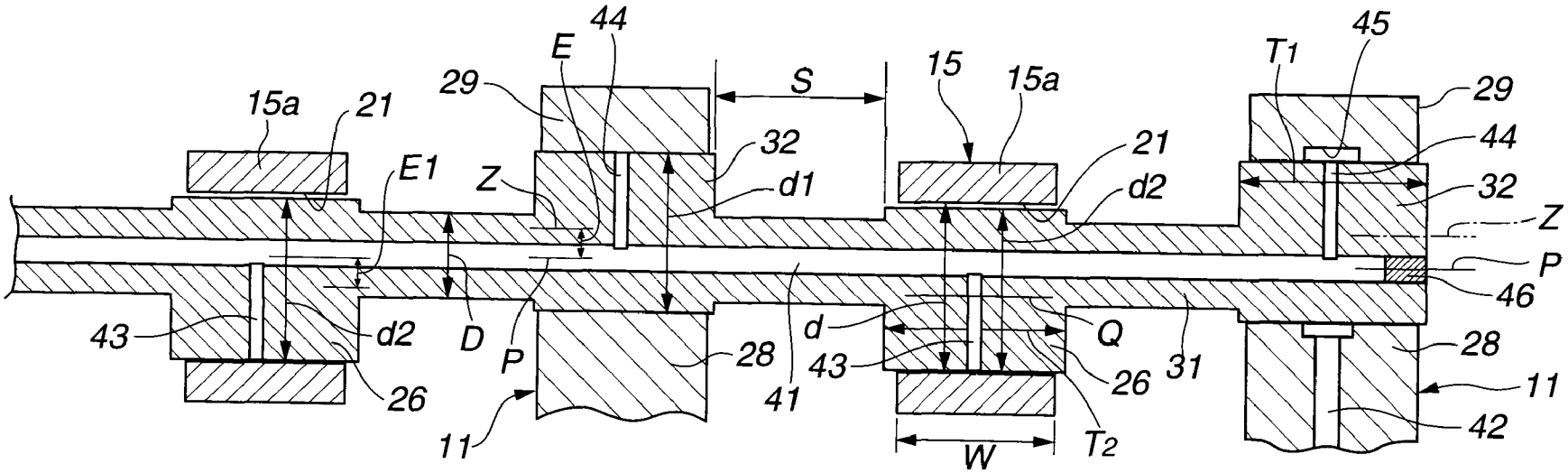
FIG. 7 is a longitudinal sectional view showing the variable valve actuating apparatus in which the control shaft is supported by bearings.
Figure 9A:
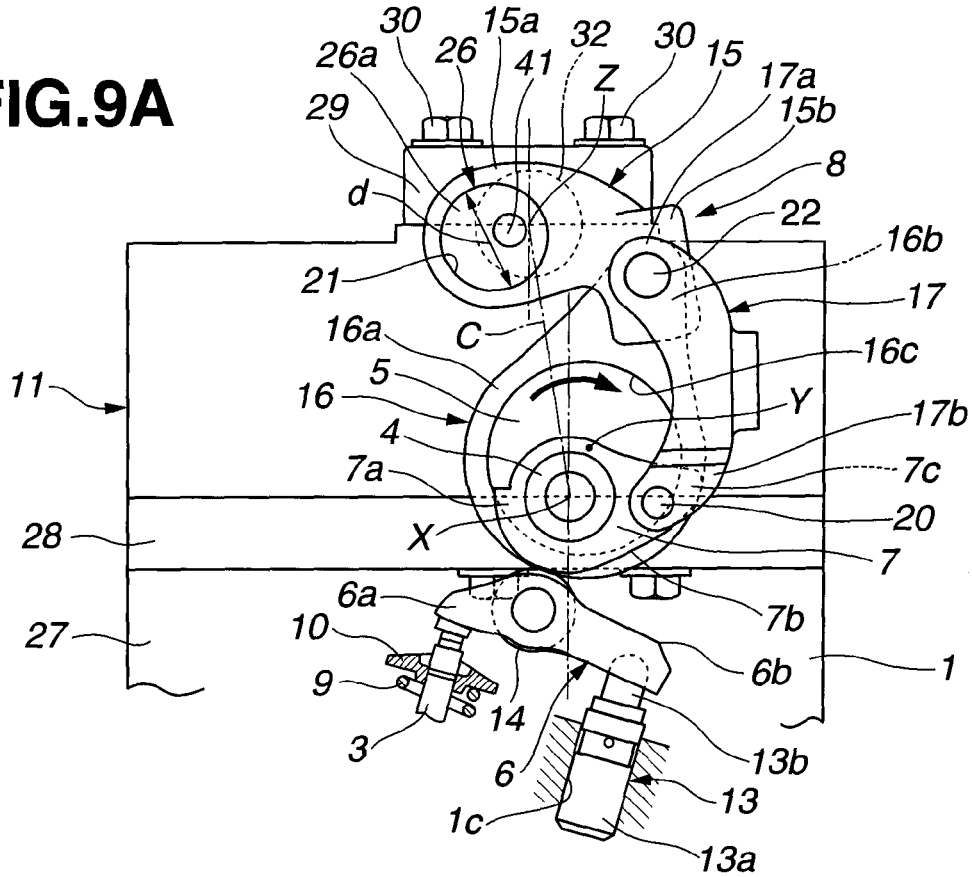
FIG. 9A is an illustrative view showing a close state of an intake valve in which the variable valve actuating apparatus according to the first embodiment is in a small lift state.
Figure 9B:
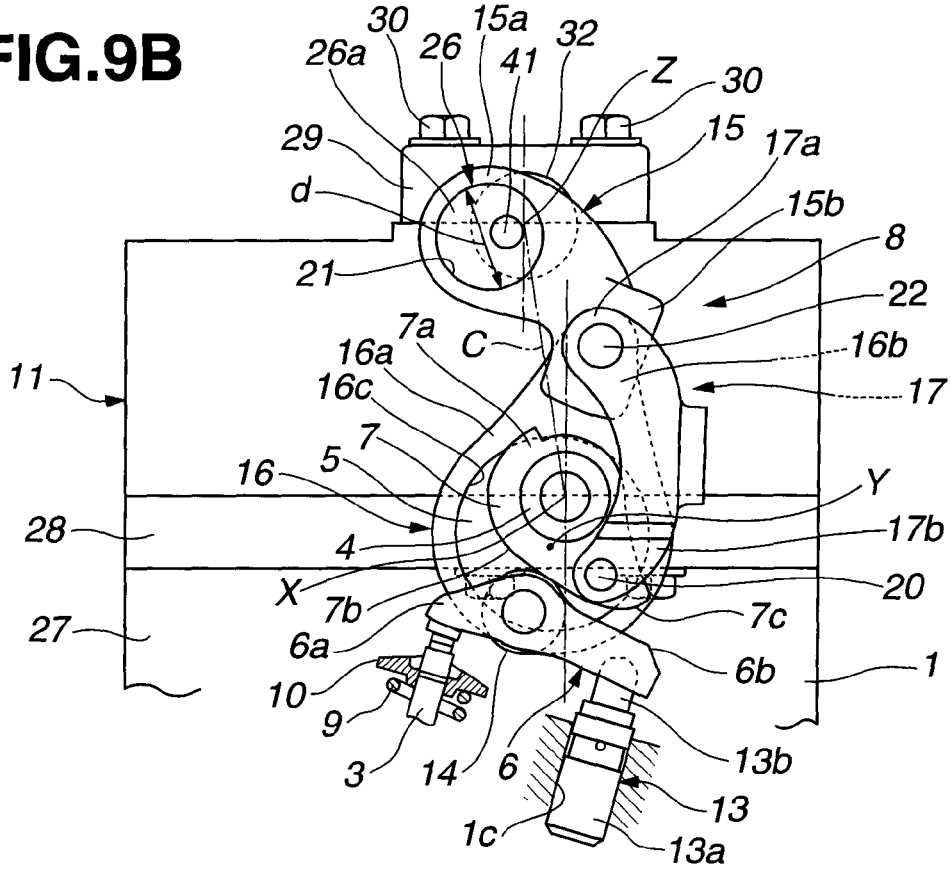
FIG. 9B is an illustrative view showing an open state of the intake valve in which the variable valve actuating apparatus according to the first embodiment is in the small lift state.
Figure 10A:
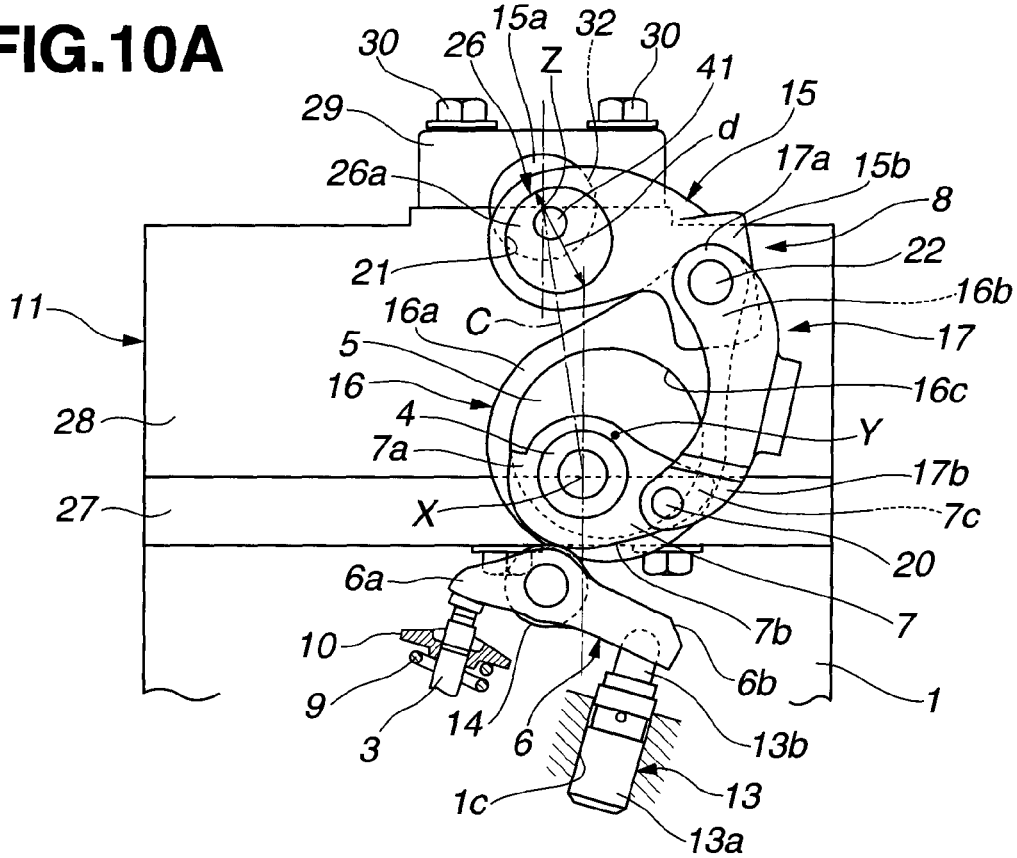
FIG. 10A is an illustrative view showing a close state of an intake valve in which the variable valve actuating apparatus according to the first embodiment is in a maximum lift state.
Figure 10B:
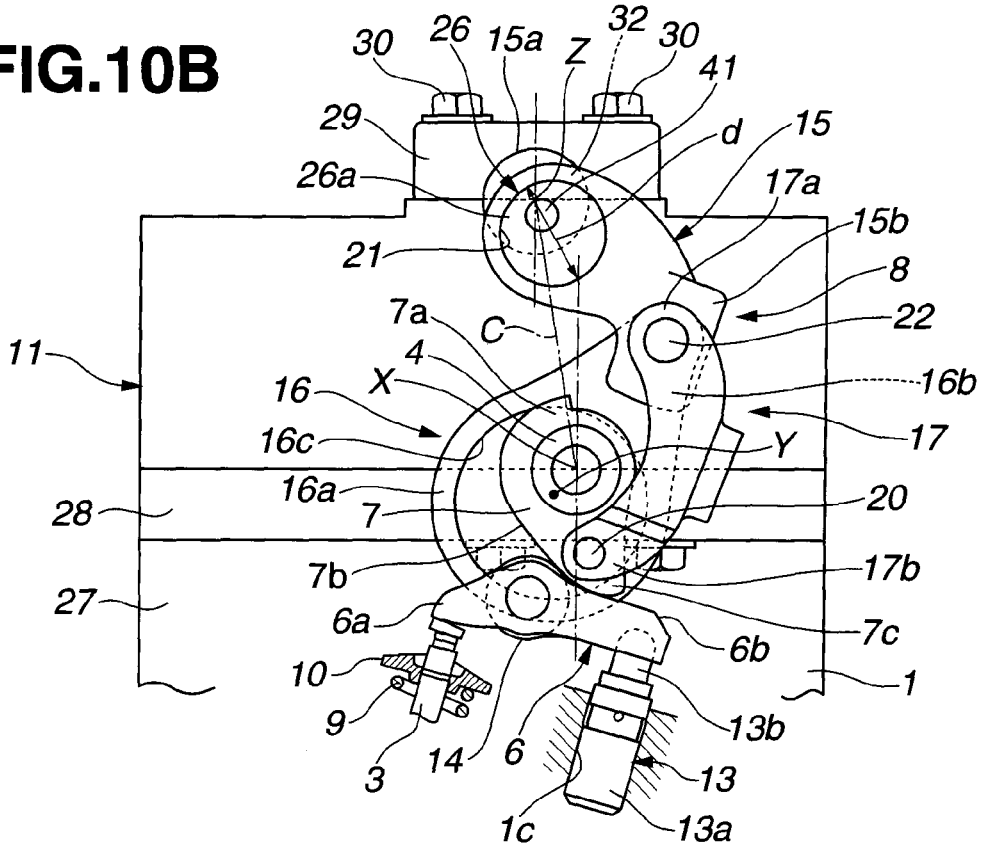
FIG. 10B is an illustrative view showing an open state of the intake valve in which the variable valve actuating apparatus according to the first embodiment is in the maximum lift state.
Figure 11:
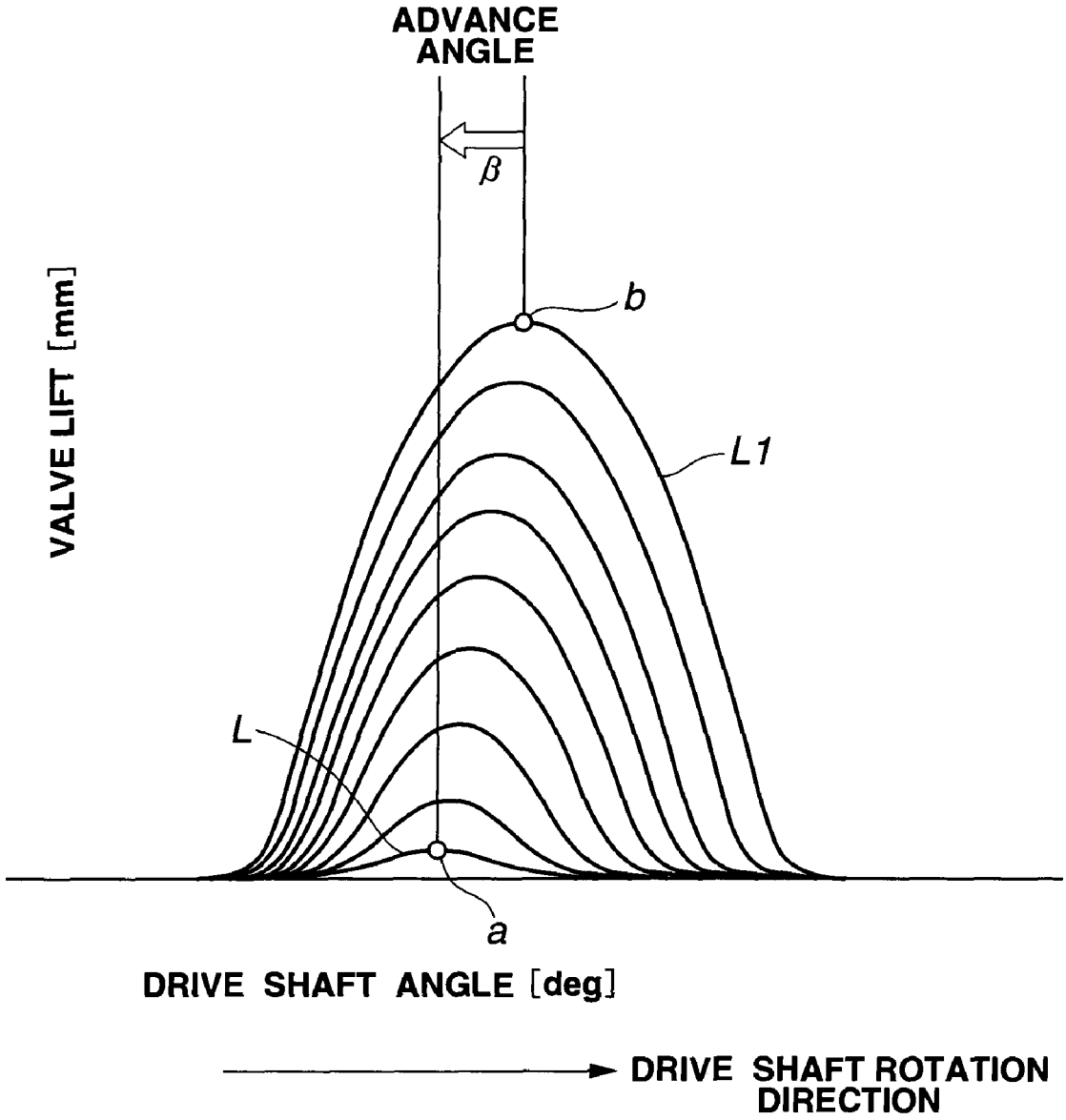
FIG. 11 is a characteristic view of a valve lift control of the intake valve in the variable valve actuating apparatus according to the first embodiment of the present invention.

FIG. 1 is a perspective view showing a control shaft and a control cam provided to a variable valve actuating apparatus according to a first embodiment of the present invention. FIG. 2 is a sectional view taken along a section line II-II of FIG. 1. FIG. 3 is a perspective view showing a main part of the variable valve actuating apparatus according to the first embodiment of the present invention. FIG. 4 is a plan view showing the main part of the variable valve actuating apparatus of FIG. 3. FIG. 5 is a front view showing the main part of the variable valve actuating apparatus of FIG. 3. FIG. 6 is a perspective view showing a rocker arm provided to the variable valve actuating apparatus of FIG. 3. FIG. 7 is a longitudinal sectional view showing the variable valve actuating apparatus in which the control shaft is supported by bearings. FIGS. 8A-8D show an assembly process of the rocker arm of the variable valve actuating apparatus. FIG. 9A is an illustrative view showing a close state of an intake valve in which the variable valve actuating apparatus is in a small lift state. FIG. 9B is an illustrative view showing an open state of the intake valve in which the variable valve actuating apparatus is in the small lift state. FIG. 10A is an illustrative view showing a closing state of an intake valve in which the variable valve actuating apparatus is in a maximum lift state. FIG. 10B is an illustrative view showing an opening state of the intake valve in which the variable valve actuating apparatus is in the maximum lift state. FIG. 11 is a characteristic view of a valve lift control of the intake valve in the variable valve actuating apparatus. As shown in FIGS. 1, 3-5, 9 and 10, the variable valve actuating apparatus includes two intake valves 3 and 3 provided to each cylinder, each slidably provided through a valve guide (not shown) to a cylinder head 1 which is a cylinder body, and each arranged to open and close an intake port; a hollow drive shaft 4 disposed in forward and rearward directions of the engine; a drive cam 5 provided to each cylinder, and fixed to drive shaft 4; swing arms 6 and 6 each of which is a follower, and each of which is disposed at an upper end portion of each intake valve 3; a pair of swing cams 7 arranged to open each intake valve 3 through the corresponding swing arm 6; a (linkage or motion) transmitting mechanism 8 arranged to connect drive cam 5 and swing cams 7 and 7, to convert the rotational force of drive cam 5 to a swing motion, and to transmit the swing motion to swing cams 7 and 7 as the swing force (valve opening force); and a control mechanism 19 arranged to vary a fulcrum for the swing motion of a rocker arm 15 described later of transmitting mechanism 8, and to vary or control a valve lift quantity and an operating angle of each intake valve 3 in accordance with the engine operating condition.

Each of valve springs 9 and 9 is elastically mounted between a spring retainer 10 provided at an upper end portion of a valve stem and a bottom portion of a substantially cylindrical bore which is received within an upper end portion of cylinder head 1. Intake valves 3 and 3 are urged, respectively, by valve springs 9 and 9 in a direction to close an opening end of each intake port.

Drive shaft 4 is rotatably supported at both end portions by bearings 11 (described later) provided at an upper portion of cylinder head 1. Drive shaft 4 receives the rotational force of a crank shaft of the engine through a follower sprocket (not shown) provided at one end portion of drive shaft 4 and a timing chain wound around the follower sprocket. Drive shaft 4 rotates in a clockwise direction shown by arrows in FIGS. 3 and 9.

Drive cam 5 is shaped like a disc, as shown in FIGS. 9 and 10. Drive cam 5 is disposed between swing cams 7 and 7. Drive cam 5 has an outer circumferential surface which is a cam profile of an eccentric circle. Drive cam 5 has an axis Y which is offset in the radial direction from an axis X of drive shaft 4 by a predetermined quantity. Drive cam 5 is integrally fixed to drive shaft 4.

Each of swing arms 6 includes a recessed first end portion 6*a* having a lower surface abutted on the stem end of one of intake valves 3; and a second end portion 6*b* having a spherical surface abutted on and supported by a hydraulic lash adjuster 13 held in a holding hole 1*c* formed in cylinder head 1. Each of swing arms 6 is arranged to be swung about the spherical end portion of hydraulic lash adjuster 13. Each of swing arms 6 includes a hollow central portion rotatably supporting a roller 14 on which swing cam 7 abuts.

Each of hydraulic lash adjusters 13 has a normal structure. Each of hydraulic lash adjusters 13 includes a cylindrical body 13*a* having a bottomed portion, and inserted into and fixed in holding hole 1*c*; and a plunger 13*b* provided within body 13*a* to be slid in the upward direction, and having the spherical end portion abutted on second end portion 6*b* of swing arm 6 from the downward direction. Hydraulic lash adjuster 13 is arranged to supply a hydraulic pressure within a reservoir through a check valve to a high pressure chamber (not shown) separated between the inner bottom portion of body 13*a* and a partition of plunger 13*b*, and to constantly adjust, to zero, a lash (gap) between the end portion of plunger 13*b* and second end portion 6*b* of swing arm 6 (between cam surface 7*b* of swing cam 7 and roller 14).

Each of swing cams 7 is shaped like a raindrop, as shown in FIGS. 9 and 10. Each of swing cams 7 has a base end portion 7*a* formed with a support hole. Each of swing cams 7 is swingably supported on the outer circumferential surface of drive shaft 4 through the support hole of base end portion 7*a* of the each swing cam 7. Each of swing cams 7 includes a cam surface 7*b* located on a lower surface of swing cam 7. Cam surface 7*b* includes a base circle surface on the base end portion 7*a*'s side; a ramp surface extending like an arc from the base circle surface toward a cam nose portion 7*c*; and a lift surface extending from the ramp surface toward a top surface (apex) at the end portion of cam nose portion 7*c* to provide a maximum or greatest lift. The cam surface 7*b* abuts on the outer circumferential surface of roller 14 of swing arm 6, and the contact point of the cam surface 7*b* shifts among the base circle surface, the ramp surface, the lift surface, and the top surface in dependence on the swing position of swing cam 7.

Swing cam 7 is arranged to be moved in a swing direction to the lift surface side to open the corresponding intake valve 3. This swing direction is set identical to the rotational direction of drive shaft 4.

Each swing cam 7 includes a pin hole which is located on the cam nose portion 7*c*'s side, which penetrates in the both side surface directions, and which receives a pin 20 connected with a second end portion 17*b* of link rod 17 described later.

As shown in FIGS. 3, 5 and 9, transmitting mechanism 8 includes a rocker arm 15 disposed above drive shaft 4 along the widthwise direction of the engine; a link arm 16 connecting rocker arm 15 and drive cam 5; and a pair of link rods 17 and 17 each connecting rocker arm 15 and one of cam nose portions 7*c* and 7*c* of swing cams 7 and 7.

As shown in FIGS. 3, 6 and 9, rocker arm 15 has a substantially V-shaped cross section. Rocker arm 15 includes a first end portion or support end portion 15*a* which is a cylindrical shape, and a second end portion or swing end portion having three-pronged shape having a first raised portion 15*b* located at a central portion, and a pair of second raised portions 15*c* and 15*c* disposed on both sides of the first raised portion 15*b*. First raised portion 15*b* and second raised portions 15*c* and 15*c* are disposed substantially parallel to one another.

The cylindrical first end portion 15*a* includes a support hole 21 penetrating in the lateral direction. A control cam 26 described later is rotatably supported and mounted in support hole 21. This support hole 21 has a size relatively smaller than a conventional supporting hole. Accordingly, first end portion 15*a* of rocker arm 15 has a sufficiently small outside diameter. Moreover, support hole 21 has an inside diameter slightly larger than outside diameters d1 and d2 of journal portion 32 and control cam 26 described later.

In the second end portion of rocker arm 15, there are formed first raised portion 15*b* having an arc end portion, and second raised portions 15*c* and 15*c* each having a substantially rectangular parallelepiped end portion extending in upward and downward directions, and disposed to sandwich first raised portion 15*b* through a predetermined gap. First raised portion 15*b* includes a pin hole 23*a* penetrating first raised portion 15*b* in the lateral direction. Each of second raised portions 15*c* and 15*c* includes a pin hole 23*b* penetrating the each of second raised portions 15*c* and 15*c* in the lateral direction. Pin hole 23*a* and pin holes 23*b* and 23*b* are substantially coaxially formed so as to receive, respectively, three connection pins 22*a*, 22*b* and 22*b*. Each of pin holes 23*b* and 23*b* of second raised portions 15*c* and 15*c* has an elongated shape in the upward and downward directions.

Link arm 16 includes a relatively large annular portion 16*a*; a protrusion 16*b* protruding outward from annular portion 16*a*; and a mounting hole 16*c* formed at a central portion of annular portion 16*a*, and rotatably mounted on the outer circumferential surface of drive cam 5. Protrusion 16*b* has a bifurcated end portion disposed to sandwich first raised portion 15*b* of the second end portion of rocker arm 15, and rotatably connected through pin hole 23*a* with connection pin 22*a*.

Each of link rods 17 is integrally formed by a press forming. Each of link rods 17 has a substantially U-shaped cross section. Each of link rods 17 includes an inside portion bent in the arc shape for the size reduction. Each of link rods 17 includes bifurcated upper first end portions 17*a* and 17*a* arranged to sandwich one of second raised portions 15*c* of the second end portion of rocker arm 15, and rotatably connected through one of connection pins 22*b* and 22*b* with the one of second raised portions 15*c* of the second end portion of rocker arm 15. Each of link rods 17 includes second end portions 17*b* and 17*b* disposed to sandwich cam nose portions 7*c* of one of swing cams 7 and 7. Each of link rods 17 is rotatably connected through pin 20 inserted through the pin hole (not shown) penetrating in the lateral direction.

Each of connection pins 20 and 22*a* is retained by a snap ring mounted on the both end portions, the staking and so on.

In each of second raised portions 15*c* and 15*c* of the second end portion of the rocker arm 15 and first end portion 17*a* of one of link rods 17 and 17, there is provided a lift adjusting mechanism arranged to perform fine adjustment of the lift quantity of the corresponding intake valve 3 at the assembly operation and so on.

This lift adjusting mechanism includes an internal screw hole extending in the upward and downward directions of second raised portions 15*c* and 15*c* of the second end portion of the rocker arm 15 across one of pin holes 23*b* and 23*b*; an adjustment screw (not shown) screwed from below the internal screw hole; and a lock screw 24 screwed from above the internal screw hole. Each of connection pins 22*b* and 22*b* is moved in the upward and downward directions in accordance with the screw quantity of the adjustment screw to adjust the length of one of link rods 17 and 17 with respect to the second end portion of the rocker arm 15. Consequently, the lift quantity of the corresponding intake valves 3 is finely adjusted. That is, connection pins 22*b* and 22*b* are substantially coaxial with connection pin 22*a*. However, the lift adjustment mechanisms can perform the fine adjustment of the position of connection pins 22*b* and 22*b* within pin holes 23*b* and 23*b* which are the elongated holes.

As shown in FIGS. 3 and 9, each of bearings 11 includes a support frame or lower ladder 27 mounted and fixed on an upper surface of an upper deck of cylinder head 1; a main bracket or upper ladder 28 each mounted and fixed on an upper surface of one of support frames 27 at regular intervals in the forward and rearward directions of the engine; and a sub bracket or cap 29 mounted and fixed on an upper surface of main bracket 28. Main bracket 28 and sub bracket 29 are joined together by a plurality of bearing bolts 30 inserted through left and right bolt insertion holes, and fixed on support frame 27 to be overlapped with each other. Drive shaft 4 is rotatably supported between support frame 27 and main bracket 28.

As shown in FIGS. 1 and 3, control mechanism 19 includes a control shaft 25 disposed above drive shaft 4 in parallel with drive shaft 4; a control cam 26 integrally fixed on the outer circumference of control shaft 25, and arranged to serve as a fulcrum for the swing motion of rocker arm 15; and an actuator arranged to control the rotation of control shaft 25.

Control shaft 25 is controlled within a rotation range smaller than 360 degrees. As shown in FIGS. 1 and 2, control shaft 25 includes a shaft portion 31 having a relatively small diameter; a plurality of journal portions 32 integrally formed on the outer circumference at predetermined positions in the axial direction, and rotatably supported, respectively, between main brackets 28 and sub brackets 29 of bearings 11. Control cam 26 forms a part of control shaft 25.

Shaft portion 31 has an outside diameter D smaller than the outside diameter d1 of journal portion 32 and the outside diameter d2 of control cam 26. Control shaft 31 includes an oil passage 41 which serves as a lubricating oil supply section, which is formed within control shaft 31, and which extends in the axial direction.

As shown in FIGS. 1, 2, 7 and 8, journal portion 32 has the outside diameter d1 larger than the outside diameter D of shaft portion 31. Journal portion 31 has a center axis Z which is off or offset from a center axis P of shaft portion 31 in one direction. This large eccentric quantity E is needed for moving the center of the swing motion of rocker arm 15 to an arbitrary position by a long distance. Journal portion 32 has an axial width T1 slightly larger than a width W of first end portion 15*a* of rocker arm 15.

One of journal portions 32 in the most rearward position is connected with a connection shaft 33 of control mechanism 19. Connection shaft 33 is integrally coaxially connected with journal portion 32 in the axial direction. This connection shaft 33 has an outside diameter smaller than the outside diameter d1 of journal portion 32. Connection shaft 33 includes an end portion fixed with a flange-shaped connection (coupling) portion 34.

Control cam 26 has a cylindrical shape having a width T2 in the axial direction which is identical to width T1 of journal portion 32. Control cam 26 has the outside diameter d2 substantially identical to the outside diameter d1 of journal portion 32. Control cam 26 has a size to be slid through a minute gap within an inner circumferential surface of support hole 21 of rocker arm 15. Control cam 26 has an axis or center Q which is off in a direction opposite to the axis Z of journal portion 32 to sandwich axis P of shaft portion 31. Accordingly, control cam 26 is eccentric from axis Z of journal portion 32 by an eccentric quantity E2 which is substantially two times larger the eccentric quantity E between axis Z of journal portion 32 and axis P of shaft portion 31.

As shown in FIGS. 7 and 8, distances S between journal portions 32 and the adjacent control cams 26 are substantially identical to each other, and are larger than the width W of first end portion 15*a* of rocker arm 15.

As shown in FIG. 1, control mechanism 19 includes an electric motor 35 fixed on a rear end portion of cylinder head 1; a ball screw mechanism 36 which is a speed reducer (reduction gear) arranged to transmit a rotational driving force of electric motor 35 to control shaft 25; and a controller 37 configured to control rotation of electric motor 33.

Electric motor 35 is a proportional type DC motor. Electric motor 35 is driven by a control signal from controller 37 configured to sense an operating condition of the engine. This controller 37 is configured to feed back the detection signals from sensors such as a crank angle sensor arranged to sense the engine rotational speed, an air flow meter arranged to sense an intake air quantity, a water temperature sensor arranged to sense a water temperature of the engine, and a potentiometer arranged to sense the rotational or angular position of control shaft 25, thereby to calculate a current operating condition of the engine, and to output the control signal to electric motor 35.

Ball screw mechanism 36 includes a ball screw shaft 38 connected with a motor shaft of electric motor 35 to receive a rotational force; and a ball nut 39 screwed on ball screw shaft 38, and arranged to linearly move in the axial direction in accordance with forward and reverse rotations of ball screw shaft 38. Ball nut 39 is pivotally connected through link member 40 with connection portion 34.

As shown in FIGS. 1 and 7, the lubricating oil supply section includes oil passage 41 formed inside shaft portion 31 in the axial direction; an oil supply passage 42 formed in the upward and downward directions inside one of bearings 11 located at a front end portion of the engine, and having one end connected with a main oil gallery (not shown); first oil holes 43 each formed inside one of control cams 26 in the radial direction, and each having a radially inner end portion connected with oil passage 41; and second oil holes 44 each formed inside one of journal portions 32 in the radial direction, and each having a radially inner end portion connected with oil passage 41.

Oil supply passage 42 has a downstream end portion connected with a groove 45 formed on an inner circumferential surface of a bearing hole between one of main brackets 28 and the corresponding sub bracket 32 of bearing 11. This groove 45 is constantly connected through second oil hole 44 with one end portion (right end as viewed in FIG. 7) of oil passage 41. The lubricating oil is constantly supplied from an oil pump through a main oil gallery into the passage.

The one end portion of oil passage 41 (right end as viewed in FIG. 7) is closed by a plug member 46. Oil passage 41 extends within connection shaft 33. The other end portion (downstream end portion) of oil passage 41 is opened in the vicinity of connection portion 34. The lubricating oil is supplied to sliding portions of actuators such as link member 40 and ball nut 39.

Hereinafter, the operation of the embodiments of the present invention will be illustrated. The mounting process of rocker arm 15 to control shaft 25 will be briefly illustrated.

Figures 8A, 8B, 8C, 8D:
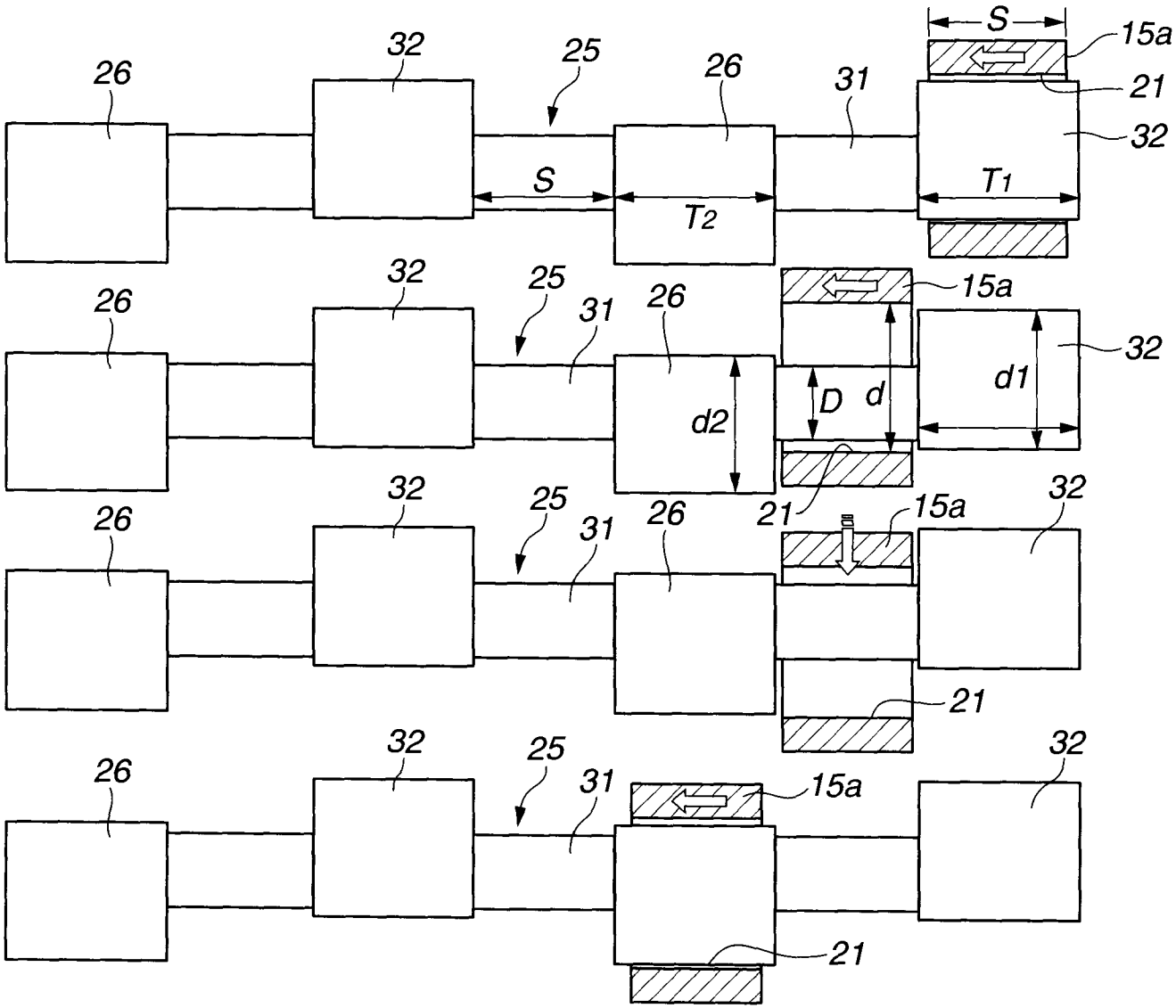
FIGS. 8A-8D show a mounting process of the rocker arm of the variable valve actuating apparatus according to the first embodiment of the present invention.

When rocker arm 15 is mounted in the axial direction from the one end of control shaft 25 (right end as shown in FIG. 8), through support hole 21 of first end portion 15*a*, support hole 21 is mounted and slid on an outer circumferential surface of journal portion 32 on the one end portion by having (manipulating) rocker arm 15, as shown by arrows of FIGS. 8A and 8B. Then, first end portion 15*a* of rocker arm 15 is moved in the radial direction on the outer circumferential side of shaft portion 31 so as to align or adjust support hole 21 with the outer circumference of one of control cams 26, as shown by an arrow of FIG. 8C. Subsequently to the state of FIG. 8C, support hole 21 is mounted on the outer circumferential surface of control cam 26, as shown in FIG. 8D. As mentioned above, rocker arms 15 are mounted, in sequence, from the right side of FIGS. 8A-8D.

Accordingly, it is possible to facilitate the mounting operation of rocker arm 15 to control shaft 25. Moreover, rocker arm 15 is further slid in the similar manner, and it is possible to readily mount rocker arm 15 to one of control cams 26 in the most forward position.

In the first embodiment, the outside diameter d2 of control cam 26 is substantially identical to the outside diameter d1 of journal portion 32. The outside diameter d1 of journal portion 32 may be smaller than the outside diameter d2 of control cam 26, as described later. In this case, it is possible to readily pass journal portion 32 through support hole 21 of rocker arm 15, and to facilitate the mounting operation of rocker arm 15.

The thus-constructed actuating apparatus according to this embodiment is operated as follows: In the low engine speed such as the idling operation of the engine, electric motor 35 rotates by the control signal from controller 37. This rotation torque is transmitted to ball screw shaft 38. Connection portion 34 and connection shaft 33 are rotated through ball nut 39, and the rotation is transmitted to journal portions 32. These journal portions 32 are rotated in one direction by the predetermined quantity. Accordingly, shaft portion 31 and control cam 26 are pivoted together in the same direction in the eccentric state as shown in FIG. 9, and held in the position shown in the drawings. The axis Q of control cam 26 rotates about axis Z of journal portion 32 by the same radius. An outer is end portion 26*a* of control cam 26 protruding beyond the outer circumference of journal portion 32 is moved in the upper left direction so as to be apart from control shaft 4.

Accordingly, the entirety of rocker arm 15 is inclined in the leftward direction with respect to a line C connecting the axis X of drive shaft 4 and the axis Z of journal portion 32, as shown in FIGS. 9A and 9B. Consequently, the second end portion of rocker arm 15 and pins 22 and 22 which are the pivot points of the link rods 17 and 17 are moved in the upward direction with respect to drive shaft 4. Therefore, the end portion of each swing cam 7 on the cam nose portion 7*c*'s side is forcibly pulled upwards by link rods 17.

Accordingly, when drive cam 5 rotates and first raised portion 15*b* of the second end portion of rocker arm 15 is pulled down through link arm 16 so as to open one of intake valves 3, the cam lift quantity is transmitted from link rod 17 through swing cam 7 to needle roller 14 of swing arm 6 as shown in FIG. 9B. Consequently, the valve lift quantity is sufficiently decreased.

Accordingly, in the low engine speed of the engine, the valve lift quantity L of each intake valve 3 becomes a sufficiently small lift curve characteristic, as shown in FIG. 11. At the moment of this peak lift, the eccentric direction of axis Y of drive cam 5 coincides with the direction of the axes of link arm 16. The moment of this peak lift is a maximum peak point a shown in FIG. 11.

Accordingly, the variable valve timing apparatus retards the closing timing of each intake valve 3, and eliminates the valve overlap with the exhaust valve. Consequently, it is possible to decrease the residual gas in the cylinder, and to improve the combustion. Therefore, it is possible to improve the fuel efficiency, and to obtain the stable rotation of the engine.

In a high engine speed region, electric motor 35 rotates in the reverse rotational direction by the control signal from controller 37, and thereby rotates ball screw shaft 38 in the same direction. Ball nut 39 is moved in the other direction by this rotation, and accordingly shaft portion 31 and control cam 26 are rotated in the other direction (in the counterclockwise direction) through journal portion 32, as shown in FIG. 10. The axis Q of control cam 26 is moved in the lower right direction (drive shaft 4's side), and positioned near line C.

Consequently, the entirety of rocker arm 15 is pivoted in the right direction, as shown in FIGS. 10A and 10B. The second end portion of rocker arm 15 pushes cam nose portion 7*c* of swing cam 7 through link rod 17 in the downward direction, so that swing cam 7 is pivoted in the clockwise direction by a predetermined distance.

Accordingly, the contact position of cam surface 7*b* of cam 7 with respect to roller 14 of swing arm 6 is moved on the cam nose portion 7*c*'s side (the lift surface portion side). Therefore, the swing quantity of swing arm 6 is sufficiently increased when the drive cam 5 is rotated at the open operation of intake valve 2 and the second end portion of rocker arm 15 is pulled down through link arm 16.

Accordingly, in this high engine speed region, valve lift quantity L1 is a maximum lift curve characteristic, as shown in FIG. 11. At the moment of this peak lift, the eccentric direction of axis Y of drive cam 5 coincides with the direction of the axes of link arm 16. The moment of this peak lift is a maximum peak point b shown in FIG. 11.

Accordingly, the variable valve actuating apparatus advances the opening timing of each intake valve 3, and increases the valve overlap with the exhaust valve. Moreover, the variable valve actuating apparatus retards the closing timing. Consequently, it is possible to improve the intake charging efficiency, and to ensure the sufficient output.

In the angle of link arm 16 at the peak lift, the angle of the maximum lift shown in FIG. 10B (peak point b of FIG. 11) is different in the phase to the angle of the minimum lift shown in FIG. 9B (peak point a of FIG. 11). The phase of the peak point a of the minimum lift is deviated in the counterclockwise direction. Accordingly, in the phase of drive shaft 4 (drive cam 5) at the peak lift, the minimum lift advances from the maximum lift by β since the rotational direction of drive cam 5 is the clockwise direction.

This characteristic that the angle advances as the valve lift shifts to the small lift is advantageous for the engine performance since the variation of the opening timing (IVO) of intake valve 3 is small, and the variation of the closing timing (IVC) is large.

The closing timing (IVC) largely affects the engine performance such as the fuel efficiency, the output, and the exhaust emission. Accordingly, it is necessary to control IVC instantaneously. In this case, the various adverse effects tend to generate when IVO is varied largely in conjunction with the instantaneous variation of IVC. For example, in a case in which IVC is advanced so as to decrease the pumping loss for improving the fuel efficiency, IVO is excessively retarded. Consequently, the pumping loss is increased, and it is not possible to sufficiently improve the fuel efficiency. Therefore, it is necessary to commonly use a valve timing control apparatus (VTC) described later, and the dependency on VTC is high.

When IVC is retarded at the acceleration of the engine to improve the intake charging efficiency so as to increase the engine output, IVO is excessively advanced. Consequently, intake valve 3 may interfere with the piston. Therefore, it is necessary to retard the angle by VTC. In general, this VTC uses the hydraulic pressure as the driving source. The conversion response to the retard angle is deteriorated. It requires the time until the engine output is increased, and accordingly the acceleration performance is decreased. Even when the vehicle shifts to the steady or normal running (fuel consumption running), it is not possible to obtain the sufficient improvement of the fuel efficiency since the response of VTC is wrong.

In this embodiment, in a case in which the variation of IVO is decreased, it is possible to obtain the advance state without excessively depending on VTC with the wrong response, and to improve the acceleration and the fuel efficiency.

In this way, it is necessary to increase the variation of the inclination angle of link arm 16 for suppressing the change of rate of IVO. It is necessary to increase offset quantity E2 of axis Q of control cam 26 with respect to journal portion 32 for increasing the variation of the inclination angle of link arm 16. In this case, it is possible to largely move the fulcrum (pin 22*a*) of link arm 16.

In this embodiment, even when the eccentric quantity of control cam 26 with respect to center axis P of shaft portion 31 of control shaft 25 is set to the small value, center axis Z of journal portion 32 is off in a direction different from the eccentric direction of control cam 26 with respect to center axis P of shaft portion 31. Accordingly, eccentric quantity E2 between center axis Q of control cam 26 and center axis Z of journal portion 32 is increased.

Accordingly, when shaft portion 31 is rotated about journal portion 32, control cam 26 is rotated about the axis Z of journal portion 32. Therefore, it is possible to sufficiently increase the eccentric quantity of the rotation.

Consequently, it is possible to decrease the size of the apparatus, and to improve the engine performance as described above.

In this embodiment, control cam 26 has the outside diameter substantially identical to the outside diameter of journal portion 32, and accordingly it is possible to improve the support rigidity (stiffness) of shaft portion 31 and control cam 31.

The position (portion) to which the driving force is transmitted from drive cam 5 and the position (portion) and the position to transmit the swing force to swing cam 7 are disposed on the second end portion of rocker arm 15. At the driving of the apparatus, it is possible to decrease the input load to control cam 26, to suppress the increase of the torque of shaft portion 31 according to the increase of eccentric quantity E2.

In this embodiment, the lubricating oil is supplied from oil supply passage 42 through groove 45 and one of second oil holes 44 to oil passage 41. Then, the lubricating oil flows from first oil hole 43 between the outer circumferential surface of control cam 26 and the inner circumferential surface of support hole 21, and flows from second oil hole 44 between the outer circumferential surface of journal portion 32 and the inner circumferential surface of the bearing hole of bearing 11. The lubricating oil sufficiently lubricates these portions. Accordingly, it is possible to effectively lubricates the rotational portions.

Oil passage 41 is linearly formed within shaft portion 31. Accordingly, it is possible to readily form oil passage 41. Oil passage 41 is formed in the axial direction of shaft portion 31, and it is possible to prevent the decrease of the rigidity of shaft portion 31.

First and second oil holes 43 and 44 are simply formed in the radial direction of control cam 26 and journal portion 32. Accordingly, it is also possible to readily form these first and second oil holes 43 and 44.

Second Embodiment

Figure 12:
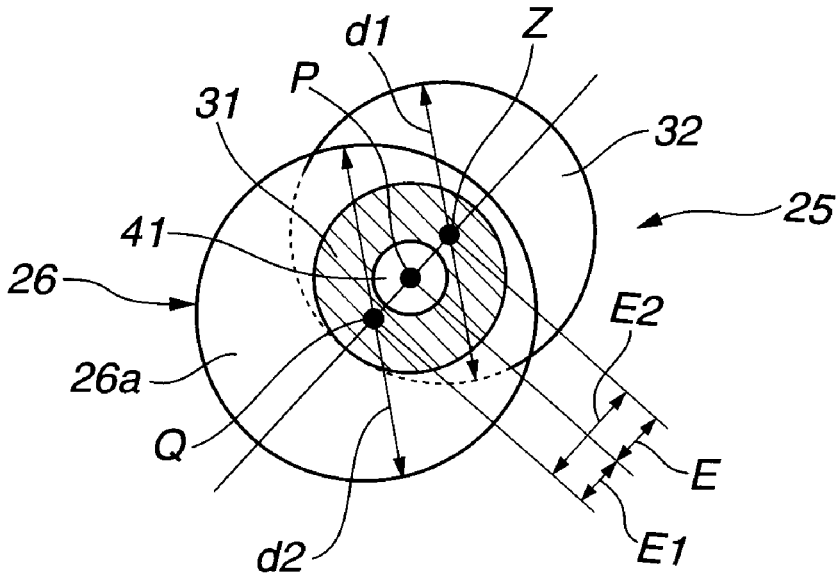
FIG. 12 is a sectional view taken along a section line II-II of FIG. 1, in a variable valve actuating apparatus according to a second embodiment of the present invention.

FIG. 12 is a sectional view taken along a section line II-II of FIG. 1, in a variable valve actuating apparatus according to a second embodiment of the present invention. Journal portion 32 has an outside diameter d1 smaller than an outside diameter d2 of control cam 26. A part of arc of the outer circumferential surface of journal portion 32 corresponds to (coincides with) a part of arc of the outer circumferential surface of shaft portion 31. That is, the part of the outer shape of journal portion 32 substantially corresponds to (coincides with) the part of the outer shape of shaft portion 31.

In the second embodiment, journal portion 32 has small outside diameter d1, and accordingly it is possible to decrease the friction when the entirety of control shaft 25 is rotated. Moreover, journal portion 32 has the outside diameter d1 smaller than inside diameter d of rocker arm support hole 21. As mentioned above, it is possible to further facilitate the mounting operation of rocker arm 15 from the axial direction of control shaft 25.

Moreover, the eccentric quantity E may be relatively increased with respect to the eccentric quantity E1 between axis P of shaft portion 31 and axis Q of control cam 26, instead of decreasing outside diameter d1 of journal portion 32. Consequently, it is possible to increase the eccentric quantity E2. The other structures are identical to the structures of the first embodiment, and accordingly it is possible to obtain the same operation and effect.

Third Embodiment

Figure 13:
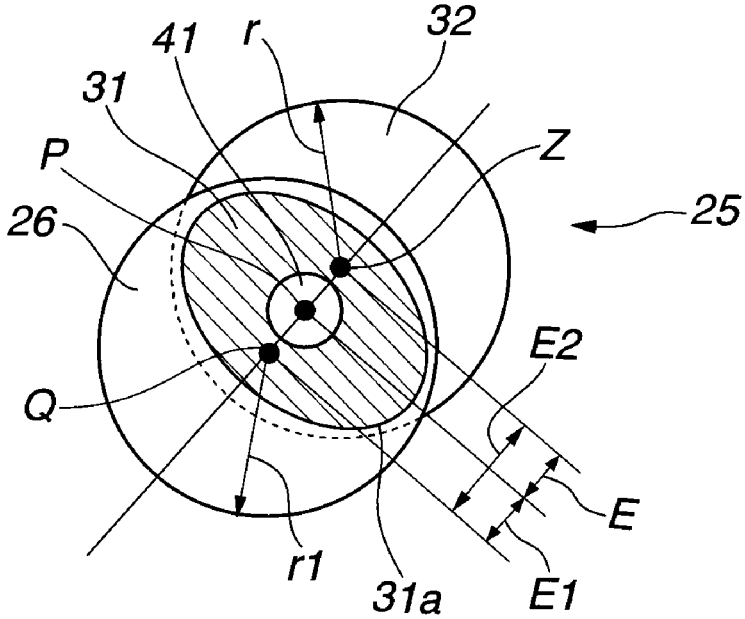
FIG. 13 is a sectional view taken along a section line II-II of FIG. 1, in a variable valve actuating apparatus according to a third embodiment of the present invention.

FIG. 13 is a sectional view taken along a section line II-II of FIG. 1, in a variable valve actuating apparatus according to a third embodiment of the present invention. Journal portion 32 has an outside diameter d1 substantially identical to outside diameter d2 of control cam 26, like the first embodiment. Shaft portion 31 has a sectional shape which is out-of-round, and which is ellipse that is in an area surrounded by a part of the outer circumference of journal portion 32 and a part of the outer circumference of control cam 26.

In this embodiment, the section area is increased, and accordingly it is possible to increase the strength of shaft portion 31, and to improve the freedom of the layout of oil passage 41.

Fourth Embodiment

Figure 14:
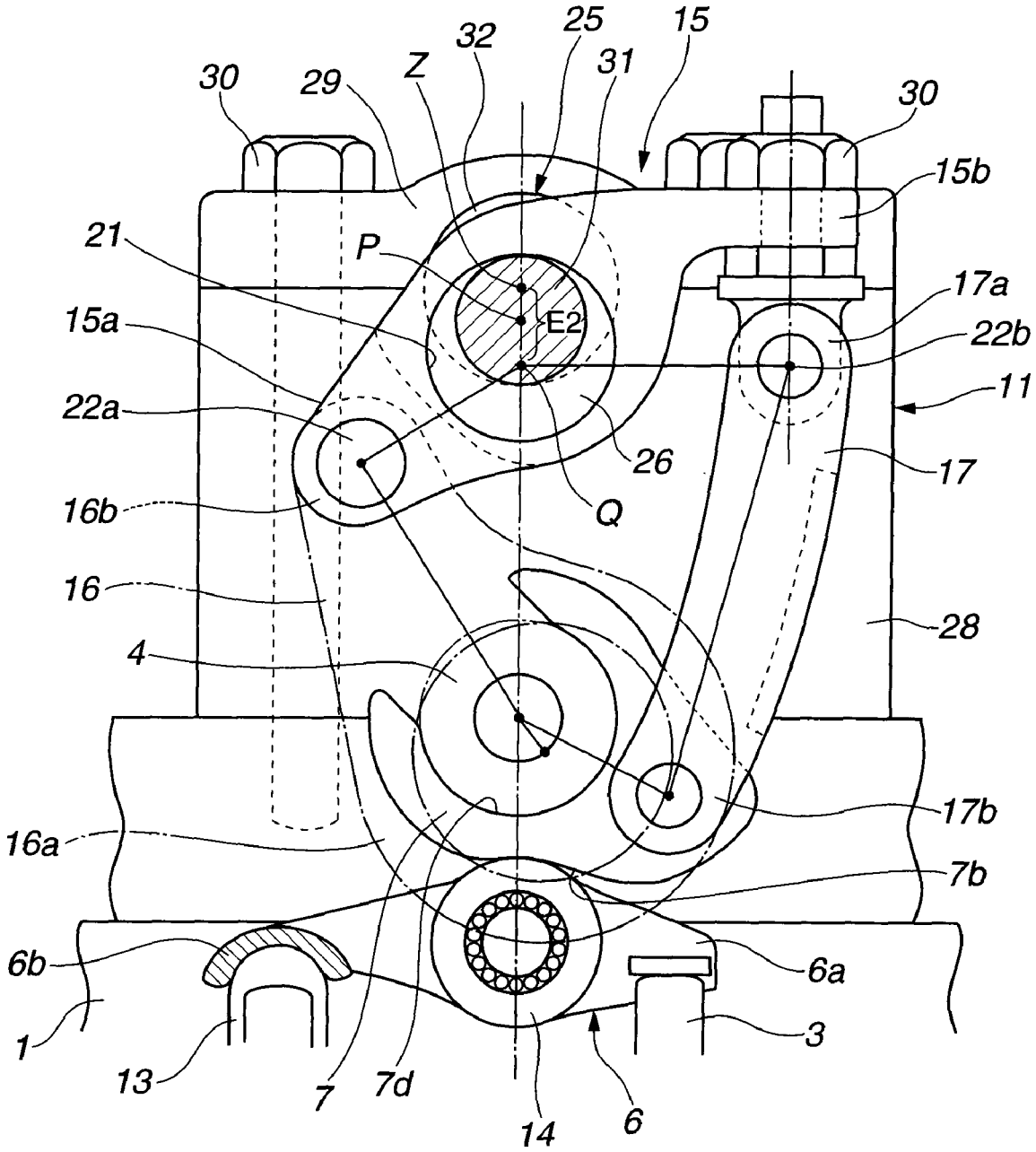
FIG. 14 is an enlarged view showing a main part of a variable valve actuating apparatus according to a fourth embodiment of the present invention.

FIG. 14 is an enlarged view showing a main part of a variable valve actuating apparatus according to a fourth embodiment of the present invention. Rocker arm 15 includes support hole 21 formed at a central annular base portion, and mounted on control cam 26. First end portion 15*a* of rocker arm 15 is connected with protrusion 16*b* of link arm 16. The second end portion of the rocker arm 15 is connected with first end portion 17*a* of link rod 17.

Swing cam 7 includes a U-shaped mounting groove 7*d* formed at a center portion, and swingably supported by drive shaft 4.

In this embodiment, rocker arm 15 is shaped like a seesaw. Accordingly, even when eccentric quantity E2 between axis Z of journal portion 32 and axis Q of control cam 26 is identical to the eccentric quantity of the first embodiment, it is possible to increase the swing quantity of swing cam 7, that is, the lift quantity variation of intake valve 3, and to further improve the engine performance.

Moreover, in a case in which the lift quantity is identical to the lift quantity of the first embodiment, it is possible to decrease the eccentric quantity E2, and thereby to decrease the size of the apparatus.

The present invention is not limited to the above-described embodiments. It is possible to vary eccentric quantity E2 between axis Z of journal portion 32 and axis Q of control cam 26, in accordance with the specifications and the size of the apparatus.

It is not necessary that the eccentric direction of axis Z of journal portion 32 is not the direction opposite to the eccentric direction of the axis Q of control cam 26. The eccentric direction of axis Z of journal portion 32 may be deviated slightly in the circumferential direction.

Moreover, the present invention is applicable to the exhaust side, and to both of the intake side and the exhaust side.

In the embodiments according to the present invention, the variable valve actuating apparatus for an internal combustion engine, the variable valve actuating apparatus includes: a control shaft rotatably supported through a bearing to a body of the engine, and arranged to rotate about a center axis to control an operating state of an engine valve, the control shaft including; a control cam having a center which is off the center axis of the control shaft in a first direction; and a journal portion rotatably supported by the bearing, the journal portion having a center axis which is off the center axis of the control shaft in a second direction different from the first direction of the control cam.

In the variable valve actuating apparatus according to the embodiments of the present invention, the center axis of the journal portion is off the center axis of the control shaft in a direction different from the eccentric direction of the control cam. Even when the eccentric quantity of the control cam with respect to the center axis of the control shaft is set to the small value, the eccentric quantity between the center of the control cam and the center axis of the journal portion is increased.

When the control shaft is rotated about the journal portion, the control cam is rotated about the axis of the journal portion. Therefore, it is possible to sufficiently increase the rotation eccentric quantity.

The entire contents of Japanese Patent Application No. 2008-74823 filed Mar. 24, 2008 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable valve actuating apparatus for an internal combustion engine, the variable valve actuating apparatus comprising:

a control shaft rotatably supported through a bearing to a body of the engine, and arranged to rotate about a center axis to control an operating state of an engine valve, the control shaft including;

a control cam having a center which is off the center axis of the control shaft in a first direction; and a journal portion rotatably supported by the bearing, the journal portion having a center axis which is off the center axis of the control shaft in a second direction different from the first direction of the control cam.

2. The variable valve actuating apparatus as claimed in claim 1, wherein the first direction of the control cam is opposite to the second direction of the journal portion.

3. A variable valve actuating apparatus for an internal combustion engine, the variable valve actuating apparatus comprising:

a control shaft arranged to rotate about a center axis to control an operating state of an engine valve, the control shaft including;

a shaft portion extending in an axial direction, and arranged to rotate about a center axis;

a substantially cylindrical control cam provided on the shaft portion, and arranged to rotate about a center; and substantially cylindrical journal portions provided on both sides of the control cam in the axial direction, and rotatably supported by bearings provided to a body of the engine, the journal portions having a center axis which is separated from the center axis of the shaft portion, and which is different from the center of the control cam.

4. The variable valve actuating apparatus as claimed in claim 3, wherein the control cam has the center which is off the center axis of the shaft portion in a first direction; the journal portions has the center axis which is off the center axis of the control shaft in a second direction opposite to the first direction of the control cam; and each of the control cam and the journal portion has an outer circumferential surface protruding from an outer circumferential surface of the shaft portion, or has an outer circumferential surface having a part which coincides with the outer circumferential surface of the shaft portion.

5. The variable valve actuating apparatus as claimed in claim 4, wherein the valve actuating apparatus further comprises a drive shaft arranged to receive a rotational force from a crank shaft, a drive cam provided to the drive shaft, a rocker arm into which the control cam is rotatably inserted, and which is arranged to be swung about the control cam by the rotation of the drive cam, a swing cam arranged to receive the swing force of the rocker arm, and to open and close an engine valve; an axial length between the control cam and one of the journal portions is longer than an axial length of a portion of the rocker arm into which the control cam is inserted; and each of the journal portions has a diameter equal to or smaller than a diameter of the control cam.

6. The variable valve actuating apparatus as claimed in claim 5, wherein each of the journal portions has the diameter smaller than the diameter of the control cam.

7. The variable valve actuating apparatus as claimed in claim 5, wherein each of the journal portions has the diameter substantially identical to the diameter of the control cam.

8. The variable valve actuating apparatus as claimed in claim 5, wherein the rocker arm has a swing end portion arranged to receive a drive force from the drive cam, and to transmit the swing force to the swing cam.

9. The variable valve actuating apparatus as claimed in claim 8, wherein the rocker arm has a support end portion which is opposite to the swing end portion, and which receives the control cam.

10. The variable valve actuating apparatus as claimed in claim 9, wherein the variable valve actuating apparatus further comprises a link arm rotatably connecting the drive cam and the rocker arm, and a link rod rotatably connecting the rocker arm and the swing cam; and the link arm and the link rod are swingably provided, respectively, to supporting shafts which are provided to the swing end portion of the rocker arm, and which are substantially coaxial with each other.

11. The variable valve actuating apparatus as claimed in claim 5, wherein the control cam is rotatably received by the rocker arm; the rocker arm includes a first end portion arranged to receive a drive force from the drive cam, and a second end portion arranged to transmit the swing force to the swing cam.

12. The variable valve actuating apparatus as claimed in claim 3, wherein the variable valve actuating apparatus further comprises an actuator arranged to rotate the control shaft in accordance with an engine operating condition, an actuator connection portion disposed at a predetermined position in the axial direction, and having a center axis identical to the center axis of the journal portions, and a rotational force transmitting section connected with the actuator connection portion, and arranged to receive a rotational force from the actuator.

13. The variable valve actuating apparatus as claimed in claim 3, wherein the control shaft is arranged to be rotated within a predetermined angle smaller than 360 degrees; and the variable valve actuating apparatus further comprises a lubricating oil supply section arranged to supply a lubricating oil between the journal portions and the bearings.

14. The variable valve actuating apparatus as claimed in claim 13, wherein the lubricating oil supply section is formed within the control shaft.

15. The variable valve actuating apparatus as claimed in claim 13, wherein the lubricating oil supply section is formed within the bearings.

16. The control shaft as claimed in claim 15, wherein the variable valve actuating apparatus further comprises an actuator arranged to rotate the control shaft in accordance with an engine operating condition, an actuator connection portion disposed at a predetermined position in the axial direction, and having a center axis identical to the center axis of the journal portion, and a rotational force transmitting section connected with the actuator connection portion, and arranged to receive a rotational force from the actuator.

17. A control shaft for a variable valve actuating apparatus, the control shaft arranged to rotate to control an operating state of an engine valve, the control shaft comprising:

a shaft portion;

a control cam including an outer circumferential surface which protrudes radially outwards from the shaft portion, whose a protruding quantity varies in accordance with a circumferential direction, and which protrudes in a first direction by a maximum quantity; and a substantially cylindrical journal portion which is supported by a bearing provided to an engine, and which is eccentric in a second direction different from the first direction of the control cam.

18. The control shaft as claimed in claim 17, wherein each of the control cam and the journal portion has an outer circumferential surface protruding radially from an outer circumferential surface of the shaft portion, or has an outer circumferential surface having a part which coincides with the outer circumferential surface of the shaft portion.

19. The control shaft as claimed in claim 18, wherein the journal portion has a diameter smaller than a diameter of the control cam.

20. The control shaft as claimed in claim 18, wherein the journal portion has a diameter substantially identical to a diameter of the control cam.

21. The control shaft as claimed in claim 17, wherein the valve actuating apparatus further comprises a drive shaft arranged to receive a rotational force from a crank shaft, a drive cam provided to the drive shaft, a rocker arm into which the control cam is rotatably inserted, and which is arranged to be swung about the control cam by the rotation of the drive cam, a swing cam arranged to receive the swing force of the rocker arm, and to open and close an engine valve; and the rocker arm is arranged to be moved in the axial direction through the control cam and the journal portion between both end portions of the control shaft at a mounting operation.

* * * * *